US007422644B2

(12) United States Patent
Barbier et al.

(10) Patent No.: US 7,422,644 B2
(45) Date of Patent: Sep. 9, 2008

(54) THIN PARTS MADE OF β OR QUASI-β TITANIUM ALLOYS; MANUFACTURE BY FORGING

(75) Inventors: Blandine Barbier, Saint Vrain (FR); Philippe Gallois, Corbeil (FR); Claude Mons, Savigny le Temple (FR); Agathe Venard, Boulogne Billancourt (FR); Pascal Vignolles, Paris (FR)

(73) Assignee: Snecma Moteurs, Paris (FR)

( * ) Notice: Subject to any disclaimer, the term of this patent is extended or adjusted under 35 U.S.C. 154(b) by 382 days.

(21) Appl. No.: 11/366,606

(22) Filed: Mar. 3, 2006

(65) Prior Publication Data

US 2006/0157170 A1 Jul. 20, 2006

Related U.S. Application Data

(62) Division of application No. 10/375,027, filed on Feb. 28, 2003, now Pat. No. 7,037,389.

(30) Foreign Application Priority Data

Mar. 1, 2002 (FR) ..... 02 02602

(51) Int. Cl.
*C22C 14/00* (2006.01)

(52) U.S. Cl. ..... 148/670; 148/421; 420/417; 420/418; 420/421

(58) Field of Classification Search ..... 148/670
See application file for complete search history.

(56) References Cited

U.S. PATENT DOCUMENTS

| | | | |
|---|---|---|---|
| 4,854,977 | A | 8/1989 | Alheritiere et al. |
| 5,026,520 | A | 6/1991 | Bhowai et al. |
| 6,110,302 | A | 8/2000 | Gorman |
| 6,284,071 | B1 | 9/2001 | Suzuki et al. |
| 2001/0050117 | A1 | 12/2001 | Oyama et al. |

FOREIGN PATENT DOCUMENTS

| | | | |
|---|---|---|---|
| EP | 0 852 164 | A1 | 7/1998 |
| EP | 0 980 961 | A1 | 2/2000 |
| EP | 1 127 949 | A2 | 8/2001 |

*Primary Examiner*—John P. Sheehan
*Assistant Examiner*—Jessee Roe
(74) *Attorney, Agent, or Firm*—Oblon, Spivak, McClelland, Maier & Neustadt, P.C.

(57) ABSTRACT

The present invention provides non-axially symmetrical manufactured parts of thickness less than 10 mm, made of β or quasi-β titanium alloy, having a core microstructure constituted by whole grains presenting a slenderness ratio greater than 4 and an equivalent diameter lying in the range 10 μm to 300 μm. The invention also provides a method of manufacturing the parts by forging.

28 Claims, 1 Drawing Sheet

THIN PARTS MADE OF β OR QUASI-β TITANIUM ALLOYS; MANUFACTURE BY FORGING

CROSS-REFERENCE TO RELATED APPLICATIONS

This application is a divisional of U.S. application Ser. No. 10/375,027, filed Feb. 28, 2003, now U.S. Pat. No. 7,037,389 the entire contents of which are incorporated herein by reference. This application is also based upon and claims the benefit of priority from the prior French Patent Application No. 02 02602, filed Mar. 1, 2002.

BACKGROUND OF THE INVENTION

1. Field of the Invention

The present invention relates to thin parts made of β or quasi-β titanium alloys, and to the manufacture of these thin parts by forging.

More precisely, the invention relates to non-axially symmetrical manufactured parts having a thickness of less than 10 millimeters (mm) made of β or quasi-β titanium alloys, presenting an original microstructure, and a method of manufacturing these parts which, in a characteristic manner, is based on a forging operation.

2. Description of the Related Art

The context in which the presently claimed invention was devised and developed is that of manufacturing single-piece bladed disks (SBD) with blades attached by linear friction welding. Because of their mechanical properties, and in particular because of their ability to withstand vibratory fatigue, such single-piece bladed disks are generally made of β or quasi-β titanium alloy. At present they are obtained by machining a solid blank.

A significant problem existed to date in obtaining the blades of such disks made of β or quasi-β titanium alloy by forging. Forged structures made of β or quasi-β titanium alloys, i.e. structures having large grains, used to make parts of small dimensions (blades), were expected a priori, to have unacceptable mechanical properties (in particular in terms of ability to withstand impacts, and resistance to vibratory fatigue).

In quite a surprising manner, in the context of the present invention, high performance blades (i.e. thin parts) made of β or quasi-β titanium alloys have been obtained (i.e., blades having good metallurgical and mechanical characteristics) by forging, thereby saving material compared with the conventionally-implemented machining technique. These blades also have lifetimes that are longer than the lifetimes of blades obtained by machining; it is possible to make them with optimized shapes, thus improving their aerodynamic performance, and consequently improving the performance of the engine in which they are to be mounted.

The invention has thus been devised and developed in a non-obvious manner in the context of manufacturing single-piece bladed disks (SBD). Nevertheless, the invention is not limited to this context; it is quite naturally equally suitable for contexts that are to some extent similar, such as that of manufacturing single-piece bladed rings (SBR), that of repairing single-piece bladed disks (SBD) and single-piece bladed rings (SBR), and more generally that of manufacturing thin parts out of β or quasi-β titanium.

Control, in accordance with the invention, over the forging of β or quasi-β titanium alloy blanks of small thickness has made it possible to obtain thin parts made of β or quasi-β titanium alloys that are original in terms of their core microstructure.

Such parts constitute the first subject matter of the present invention.

The controlled forging method which leads to such parts constitutes the second subject matter of the invention.

BRIEF SUMMARY OF THE INVENTION

In a first aspect, the present invention thus provides manufactured parts that are non-axially symmetrical (i.e. excluding wires) having a thickness less than 10 mm (where 10 mm defines the concepts of "small thickness" and "thin parts" as used in the present specification), that are made of β or quasi-β titanium alloys having core microstructure constituted by whole grains presenting a slenderness ratio greater than 4, and that have an equivalent diameter lying in the range of 10 micrometers (μm) to 300 μm.

β or quasi-β titanium alloys are familiar to the person skilled in the art, where the term "quasi-β" alloy is used to designate an alloy that is close to β microstructure. They present a compact hexagonal structure. They are well-defined, in particular in US handbooks: the American Society Material Handbook (ASMH) and the Military Handbook (MILH). At present, their use is restricted to manufacturing forged parts that are massive or of large thickness.

In a characteristic manner, the manufactured parts of the invention made of these alloys are thin parts which carry inherent traces of their method of manufacture which is based on one or more forging operations. Their core microstructure is original with grains that have been welded.

They present a slenderness ratio greater than 4; the slenderness ratio being conventionally defined as the ratio of the longest dimension over the smallest dimension in an axial section plane.

They present an equivalent diameter lying in the range of 10 μm to 300 μm.

Instead of the large truncated grains that are to be found in the structure of equivalent (thin) parts obtained by machining, the grains which are found in the core of a part of the invention are whole, flattened, and lens-shaped.

Because of their characteristics specified above, parts manufactured in accordance with the invention are novel parts obtained by forging. As explained above, a significant challenge existed to date to obtain thin structures by forging thicker structures having large grains, and in quite a surprising manner, such thin structures have been found to present characteristics that are very advantageous.

The manufactured parts of the invention advantageously constitute the blades of compressors for turbomachines.

Nevertheless, the invention is not limited in any way to that context. The parts in question may also constitute propellers, in particular for submarines, or blades for fans or mixers that are required to operate in an environment justifying or requiring blades made out of β or quasi-β titanium alloys. This list is not exhaustive.

In a particularly preferred variant (which is not limiting in any way), the manufactured parts of the invention are made of $Ti_{17}$ alloy. This alloy, which is familiar to the person skilled in the art, is presently used for making massive parts, in particular the disks of compressors. It presents high flow stresses and also has the reputation of being difficult to forge.

More precisely, it is the following alloy:

$TA_5CD_4$ in metallurgical nomenclature;

$TiAl_5Cr_2Mo_4$ in chemical nomenclature.

In quite a surprising manner, in the context of the presently claimed invention, the inventors have forged thin parts out of $Ti_{17}$ alloy with large welding ratios, the forged parts presenting high quality mechanical properties.

In a second aspect, the present invention provides a method of manufacturing the above-described novel parts.

The manufacturing method of the invention comprises:

obtaining an enameled blank;

where necessary, transforming said blank into a long part of equivalent diameter less than 100 mm;

forging said long part;

quenching said forged long part; and tempering said quenched forged long part.

In a conventional manner, the part that is to be forged is initially enameled.

The part is generally constituted by a semi-finished part obtained by extruding (spinning) or forging a starting material of larger equivalent diameter (of greater thickness). It may be constituted in particular by a bar (e.g. having a diameter of 25 mm) obtained by extruding a billet. β or near-β titanium alloys are mainly available in the form of such billets (for manufacturing compression disks by machining).

This enameled part, i.e. generally an enameled semi-finished part, having an equivalent diameter of less than 100 mm, is transformed in the invention by forging into a manufactured part having a thickness of less than 10 mm.

To obtain such a manufactured part having optimized properties, it is recommended that forging be implemented under the following conditions. The forging operation comprises at least two heating operations:

a first heating operation below or above the D transition, generally at a temperature lying in the range 700° C. to 1000° C.; and a final heating operation above the D transition, generally at a temperature greater than 880° C.

The temperatures in question naturally depend on the particular β or quasi-β Ti alloy used.

The reduction ratio during each heating operation is greater than or equal to 2 (advantageously greater than 2) and the forging speeds (or flattening speeds) lie in the range 1 per second ($s^{-1}$) to $1\times10^{-5}$ $s^{-1}$.

The forging operation may be limited to two heating operations as specified above (the second of the two heating operations necessarily taking place at above the β transition). It may include an additional heating operation below or above the β transition, prior to the final (third) operation performed above the β transition. The forming operation may include more than three heating operations (the last operation necessarily taking place above the β transition), but the advantage of multiplying the number of heating operations in this way is not clear.

The forging operation thus generally includes two or three heating operations, implemented under the conditions specified above.

Conventionally, the forged part is optionally re-enameled between two successive heating operations.

In an advantageous variant implementation, the forging matrix is maintained at a temperature lying in the range 100° C. to 700°.

The forging operation is conventionally followed by a quenching operation (is generally followed immediately by such quenching). Such quenching can be implemented in particular in forced air, in still air, in a bath of oil, or on a matrix. It is advantageously implemented under conditions which induce a cooling speed that is less than or equal to the speed induced by quenching in a bath of oil.

The quenched forged part is advantageously tempered at a temperature lying in the range of 620° C. to 750° C. for a period of 3 hours (h) to 5 h. These operating conditions are optimized as a function of the characteristics desired for the final part. If the enamel has cracked or flaked, care is taken to perform such tempering under an inert atmosphere (in particular a vacuum or argon).

In a particularly advantageous variant, the method of the invention is implemented under the following conditions:

the blank is made of $TI_{17}$ alloy ($TA_5CD_4$ or $TiAl_5Cr_2MO_4$);

forging comprises a first heating operation to a temperature less than or equal to 840° C.±10° C. (below the β transition), or to a temperature greater than or equal to 940° C.±10° C. (above the β transition), and a second heating operation is performed at a temperature of 940° C.±10° C. (above the β transition);

quenching is implemented on a matrix and then in still air; and tempering is implemented at 630° C. for 4 h.

This produces a part of the kind described in the introduction to the present specification, which part can constitute, in particular, a blade.

The manufacture of such a blade is described in greater detail in the following example given purely by way of illustration.

BRIEF DESCRIPTION OF THE DRAWING

Accompanying

DETAILED DESCRIPTION OF THE INVENTION

Figure 1:
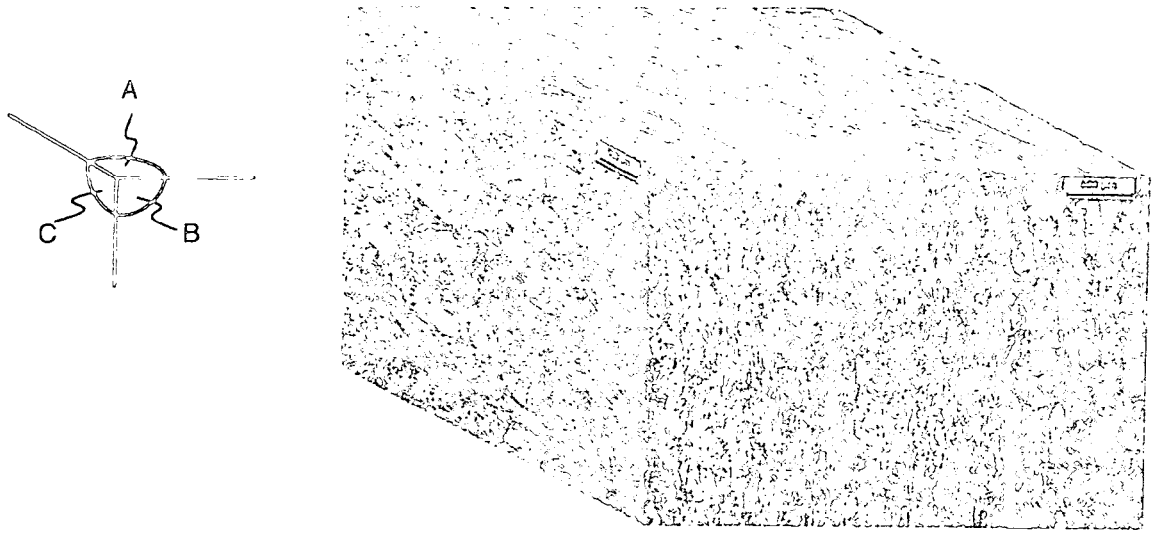
FIGS. 1 and 2 show the core microstructure—the novel microstructure—of such a blade at two different scales.

FIG. 1 is a section in three directions: a cross-section on plane A, a longitudinal section on plane B, and a face section on plane C; magnification is ×20; the lens shape of the grains can clearly be seen: they are very flattened in the transverse and longitudinal directions and present large faces in the face section.

Figure 2:
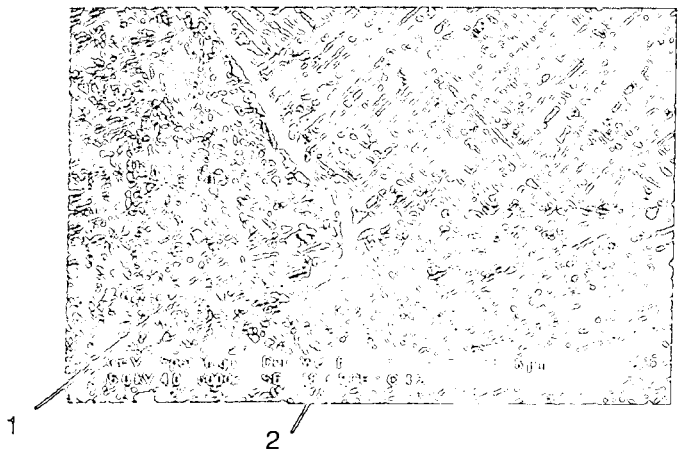

In FIG. 2 magnification is much greater: ×5000. FIG. 2 shows the internal microstructure of the grains. A cold hammered grain is referenced 1, and a recrystallized grain is referenced 2. The α needles are very fine and thoroughly entangled.

Example: manufacturing a $Ti_{17}$ blade by forging.

The method implemented comprised the following steps in succession:

extruding a bar (ø<100 mm) so as to obtain a blank (ø=27 mm) with a length of 240 mm:

enameling;

radially flattening the extruded bar to form the blade and its root;

raising the forging matrix to 200° C.;

striking speed (screw press)=$10^{-4}$ $s^{-1}$;

first heating operation: the enameled blank maintained for 45 minutes (min) at 940° C. (operation above the β transition) was flattened to present thickness lying in the range of 13 mm to 8 mm;

second heating operation: conditions identical to the first, the new flattening operation forming a part having a thickness varying over the range of 9 mm to 1 mm;

cooling on a matrix and then in still air on a table; and direct tempering after forging at 630° C. for 4 h.

This provided a blade having core microstructure of the kind shown in the accompanying figures.

What is claimed is:

1. A method of manufacturing a non-axially symmetrical part having a thickness less than 10 mm, and made of "quasi-β" titanium alloy, said method comprising:

obtaining an enameled blank;

transforming the blank into a long part of equivalent diameter less than 100 mm;

forging the long part with a final heating operation carried out at a temperature above a β transition;

quenching the forged long part; and tempering the quenched forged long part.

2. The method according to claim 1, wherein the part has a core microstructure comprising whole grains having a slenderness ratio greater than 4 and an equivalent diameter lying in the range of 10 μm to 300 μm.

3. The method according to claim 1, wherein the part is a part selected from the group consisting of a compressor blade, a single-piece bladed disk, a single-piece bladed ring, a propeller, a fan blade, and a mixer blade.

4. The method according to claim 2, wherein the quasi-β titanium alloy is a $Ti_{17}$ alloy ($TA_5CD_4$ or $TiAl_5Cr_2Mo_4$).

5. The method according to claim 1, wherein the forging comprises at least two heating operations, the first to a temperature that is below or above the β transition, and the last to a temperature that is above the β transition, a reduction ratio on each heating operation being greater than or equal to 2, and a forging speed lying in the range of $1s^{-1}$ to $1\times10^{-5}s^{-1}$.

6. The method according to claim 5, wherein the forging comprises first and second heating operations that are independently above or below the β transition, and a third heating operation that is above the β transition.

7. The method according to claim 5, further comprising:

re-enameling the part between two heating operations.

8. The method according to claim 1, wherein a forging matrix is maintained at a temperature lying in the range of 100° C. to 700° C.

9. The method according to claim 1, wherein quenching is implemented under conditions which induce a cooling speed that is less than or equal to the speed induced by quenching in a bath of oil.

10. The method according to claim 1, wherein the tempering is implemented at a temperature lying in the range 620° C. to 750° C. for a period lying in the range 3 h to 5 h.

11. The method according to claim 1, wherein the blank is made of $Ti_{17}$ alloy ($TA_5CD_4$ or $TiAl_5Cr_2Mo_4$).

12. The method according to claim 1, wherein the forging comprises a first heating operation at a temperature less than or equal to 840° C ±10° C or at a temperature greater than or equal to 940° C ±10° C and a second heating operation at a temperature of 940° C ±10° C.

13. The method according to claim 12, wherein the quenching is implemented on a matrix and then in still air.

14. The method according to claim 13, wherein the tempering is implemented at 630° C for 4 h.

15. The method according to claim 1, wherein the whole grains comprise lens-shaped forms and non β-parts within the whole grains comprising α-needles.

16. A method of manufacturing a non-axially symmetrical part having a thickness less than 10 mm, made of a quasi-β titanium alloy, and having a core microstructure comprising whole grains having a slenderness ratio greater than 4 and an equivalent diameter lying in the range of 10 μm to 300 μm, the method comprising:

obtaining an enameled blank;

transforming the blank into a long part of equivalent diameter less than 100 mm;

forging the long part with a final heating operation carried out at a temperature above a β transition;

quenching the forged long part; and tempering the quenched forged long part.

17. The method according to claim 16, wherein the forging comprises homogeneously forging the entire long part.

18. The method according to claim 16, wherein the part is a part selected from the group consisting of a compressor blade, a single-piece bladed disk, a single-piece bladed ring, a propeller, a fan blade, and a mixer blade.

19. The method according to claim 16, wherein the quasi-β titanium alloy is a $Ti_{17}$ alloy ($TA_5CD_4$ or $TiAl_5Cr_2Mo_4$).

20. The method according to claim 16, wherein the forging comprises at least two heating operations, the first to a temperature that is below or above the β transition, and the last to a temperature that is above the β transition, a reduction ratio on each heating operation being greater than or equal to 2, and a forging speed lying in the range of $1\ s^{-1}$ to $1\times10^{-5}s^{-1}$.

21. The method according to claim 20, wherein the forging comprises first and second heating operations that are independently above or below the β transition, and a third heating operation that is above the β transition.

22. The method according to claim 20, further comprising:

re-enameling the part between two heating operations.

23. The method according to claim 16, wherein the obtaining comprises extruding a bar so as to obtain the enameled blank.

24. The method according to claim 16, wherein a forging matrix is maintained at a temperature lying in the range of 100° C. to 700° C.

25. The method according to claim 16, wherein quenching is implemented under conditions which induce a cooling speed that is less than or equal to the speed induced by quenching in a bath of oil.

26. The method according to claim 16, wherein the tempering is implemented at a temperature lying in the range 620° C. to 750° C. for a period lying in the range 3 h to 5 h.

27. The method according to claim 16, wherein the blank is made of $Ti_{17}$ alloy ($TA_5CD_4$ or $TiAl_5Cr_2Mo_4$), the forging comprises a first heating operation at a temperature less than or equal to 840° C.±10° C. or at a temperature greater than or equal to 940° C.±10° C. and a second heating operation at a temperature of 940° C.±10° C., the quenching is implemented on a matrix and then in still air, and the tempering is implemented at 630° C. for 4 h.

28. The method according to claim 16, wherein the whole grains comprise lens-shaped forms and non β-parts within the whole grains comprising α-needles.

* * * * *